US007311290B1

(12) United States Patent
Barnes

(10) Patent No.: US 7,311,290 B1
(45) Date of Patent: Dec. 25, 2007

(54) COMPONENT AWNING AND LIGHT SUPPORT SYSTEM

(76) Inventor: Michael S. Barnes, 3595 Canton Hwy., A-9 #275, Marietta, GA (US) 30066

( * ) Notice: Subject to any disclaimer, the term of this patent is extended or adjusted under 35 U.S.C. 154(b) by 0 days.

(21) Appl. No.: 11/200,464

(22) Filed: Aug. 10, 2005

(51) Int. Cl.
*A47F 5/00* (2006.01)

(52) U.S. Cl. ..... 248/301; 52/74; 248/201

(58) Field of Classification Search ..... 248/200, 248/201, 205.1, 236, 235, 247, 248, 249, 248/250, 251, 252, 254, 255, 253, 261, 262, 248/263, 266, 267, 273, 300, 304, 309.1, 248/311.2, 312.1, 65, 68.1, 256, 268, 48.1, 248/48.2, 345; 52/74, 75, 76, 77, 78; D25/57, D25/68

See application file for complete search history.

(56) References Cited

U.S. PATENT DOCUMENTS

| | | | | | |
|---|---|---|---|---|---|
| 167,422 | A | * | 9/1875 | Abbott | 248/48.1 |
| D30,108 | S | * | 1/1899 | Heib | D8/373 |
| 848,950 | A | * | 4/1907 | Wyler | 248/68.1 |
| 891,406 | A | * | 6/1908 | Cassens | 210/542 |
| 909,353 | A | * | 1/1909 | White | 248/256 |
| 1,021,330 | A | * | 3/1912 | Price | 248/284.1 |
| 1,206,203 | A | * | 11/1916 | Brockway | 248/68.1 |
| 1,454,557 | A | * | 5/1923 | Oswald | 248/256 |
| 1,541,774 | A | * | 6/1925 | Kuziel | 248/256 |
| 1,568,538 | A | * | 1/1926 | Argo | 248/301 |
| 1,795,657 | A | * | 3/1931 | Gunnar | 248/263 |
| 2,138,507 | A | * | 11/1938 | Pisciotta | 248/256 |
| 2,293,662 | A | * | 8/1942 | Richardson | 160/19 |
| 2,354,404 | A | * | 7/1944 | Sayles | 248/72 |
| 2,655,336 | A | * | 10/1953 | McGowan | 248/259 |
| 2,682,689 | A | * | 7/1954 | Helt | 52/473 |
| 2,685,716 | A | * | 8/1954 | Evans | 52/76 |
| 2,799,464 | A | * | 7/1957 | D Azzo | 248/273 |
| 2,890,853 | A | * | 6/1959 | D Azzo | 248/273 |
| 3,333,803 | A | * | 8/1967 | Landis | 248/48.2 |
| 3,782,062 | A | * | 1/1974 | Woods et al. | 52/75 |
| 3,851,848 | A | * | 12/1974 | Wiele | 248/273 |
| 3,900,110 | A | * | 8/1975 | Soroka | 211/113 |
| 3,949,960 | A | * | 4/1976 | McKee | 248/220.21 |
| 4,000,587 | A | * | 1/1977 | Weber | 52/16 |
| 4,192,112 | A | | 3/1980 | Reilly, Sr. | |
| D275,422 | S | * | 9/1984 | Dello Russo | D25/68 |
| D285,529 | S | * | 9/1986 | Huxhold et al. | D8/372 |
| 5,148,849 | A | | 9/1992 | Faludy | |
| 5,197,797 | A | | 3/1993 | Jaksich | |
| 5,394,921 | A | * | 3/1995 | Lohausen | 160/22 |
| 6,273,385 | B1 | * | 8/2001 | Hambleton | 248/304 |
| 6,301,836 | B1 | * | 10/2001 | Richardson | 52/11 |
| 6,739,371 | B2 | | 5/2004 | Mukai | |

(Continued)

*Primary Examiner*—Carl D. Friedman
*Assistant Examiner*—Bradley H Duckworth
(74) *Attorney, Agent, or Firm*—Kirton & McConkie; Michael F. Krieger

(57) ABSTRACT

A kit of components for constructing and installing an awning and light support system to provide sun and weather protection to a window or door of a structure. Included therein are a pair of uniquely constructed bracket members having an L-shaped configuration with the respective free ends of the legs termination in an angled L-shape configuration, where the latter are used to removably secure an awning spar to support the awning material. Additionally, the bracket member includes a short horizontal arm, projecting from a first leg of the bracket member within the plane of the bracket member, from which may be secured a lighting fixture.

14 Claims, 2 Drawing Sheets

U.S. PATENT DOCUMENTS 6,935,074 B2 * 8/2005 Gramling ..... 52/11
2003/0009951 A1 * 1/2003 Bergeron ..... 52/12
2006/0157629 A1 * 7/2006 Silverman ..... 248/310

* cited by examiner

COMPONENT AWNING AND LIGHT SUPPORT SYSTEM

FIELD OF THE INVENTION

This invention is directed to the field of awning support systems, such as may be used in shading windows, doors, and the like, more particularly to a readily mounted support system that includes a pair of L-shaped brackets positioned at the sides of the windows, doors, and the like, where a feature of said brackets is an intermediate, light supporting arm to provide illumination under the awning.

BACKGROUND OF THE INVENTION

The present invention relates to an easily installed awning system, especially to a pair of L-shaped brackets for mounting to the respective sides of a window or door, where the system may be readily handled by a single installer.

Typically, prior art systems are constructed of a single unit, though the unit includes supporting brackets, the awning cover and awning side members. The unit is usually shipped to the installation site, where installation often requires special skills, and once installed is difficult to remove. Finally, such prior art systems are not adjustable or flexible to fit different sized windows and doors.

Further prior art systems are taught in the patented art as reflected in the following U.S. Patents:

a.) U.S. Pat. No. 3,949,960, to McKee, discloses a bracket system for mounting the box or housing of retractable roll-up awnings on curved or straight sides of recreational vehicles. The bracket system includes a generally L-shaped mounting bracket for supporting the awning housing, bracket clamps for securing the housing to the mounting bracket, and an adapter bracket for supporting the mounting bracket on a variety of curved sloping surfaces such as exterior walls of recreational vehicles. The bracket clamp engages with the mounting bracket by means of a dovetail mortise and tenon joint while the awning housing is secured to the mounting bracket and bracket clamp by tongue and groove engagement. The mounting bracket is supported on the adapter bracket by a keyhole mortise and tenon joint in cooperation with a tongue and groove joint. The adapter bracket is designed to provide a plurality of mounting positions in order to accommodate the mounting bracket to a wide variety of curved walls or surfaces on recreational vehicles.

b.) U.S. Pat. No. 4,192,112, to Reilly, Sr., teaches a pliable awning system consisting of a head bar means adapted to be mounted on a building and the like for support and a front bar means adapted to be mounted on posts and the like with a pliable awning extending between the building and the posts; the awning having securing means fastened to both ends for securing said awning to said head bar means and said front bar means with adjustable means mounted on the front bar means for rendering the pliable awning taut.

c.) U.S. Pat. No. 5,148,849, to Faludy, is directed to a lighted retractable awning that includes a roll bar about which a canopy can be rolled with the roll bar having an elongated recess therein adapted to receive a light source. The light source includes an electrical cord having a plug on one end adapted to be received in an electrical outlet in a support surface on which the awning is mounted.

d.) U.S. Pat. No. 5,197,797, to Jaksich, relates to an elongated transparent lighting fixture having an open ended tubular housing formed with an interior chamber for telescopic receipt of an elongated channel-shaped rail formed having opposed inturned longitudinal flanges defining therebetween passageways. A plurality of L-shaped mounting brackets are configured with respective horizontally disposed foot plates, the opposite marginal edges thereof forming sliders received slidably under the rail flanges. The opposite leg of the respective brackets then form vertically projecting mounting plates which mount respective sockets for receipt of the opposite ends of tubular electrical lamps to mount them with the bottom peripheral segments thereof recessed into said passageway. One mounting bracket is formed with an elongated strip disposed in heat exchange relationship with heat emitting electrical components to provide for efficient transfer to the channel which will act as a heat sink.

e.) U.S. Pat. No. 6,739,371, to Mukai, discloses an awning installing device that includes a main body having first and second opposing major surfaces, with a given width and appropriate thickness and length. The first major surface is adapted to be brought into contact with a facade wall onto which an awning is to be installed, and the awning is to be mounted on the second major surface. A groove is formed in the main body to open at the second major surface and extend along the entire length of the main body. A bracket for supporting the awning has a portion which is movable in and along the groove to a desired location where it can be fixed. The main body is provided with a plurality of securing holes. Screws can be screwed through selected ones of the securing holes into the wall for securing the main body. End securing members which close the both ends of the groove are used to secure the ends of the main body to walls extending perpendicularly to the facade wall.

Unfortunately, the commercial systems, and those of the above noted prior art, fail to provide a suitable awning and light support system that can be readily installed by a week end do-it-yourself handyman in the manner of the present invention. The system hereof and the manner by which such support system may be easily installed will become more apparent in the description and drawings which follow.

SUMMARY OF THE INVENTION

This invention relates to an awning and light support system, and to a kit of components, to provide for the easy installation of sun and rain protection to an opening, such as a window or door, of a structure. The system and kit of components comprises a pair of L-shaped bracket members for mounting at respective sides of the structure's selected opening. Each bracket member comprises a first vertically oriented leg with means for removably attaching the bracket member to the structure, and a second horizontally oriented leg joined to said first leg. The respective arms include remote free ends that exhibit an L-shaped configuration for removably securing an awning spar. Additionally, each bracket member features a horizontally directed arm extending perpendicularly from the first vertically oriented leg in the plane of the bracket member for mounting a light fixture. Finally, fasteners may be used to conveniently anchor the bracket members to the structure.

Accordingly, a feature of the invention is an awning and light support system consisting of a pair of brackets that can be readily installed by a do-it-yourself handyman.

Another feature of the awning and light support system is the provision of a support bracket that includes means for mounting a light fixture.

A further feature thereof is an awning and light support system, through a simple kit of components, that may be easily installed by a single person.

These and other features of the invention will become clearer in the following specification, particularly when read in conjunction with the accompany drawings.

DETAILED DESCRIPTION

Figure 1:
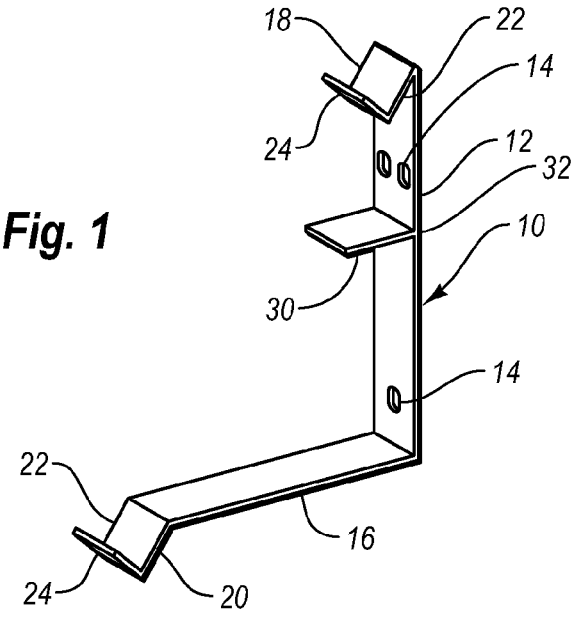
FIG. 1 is a perspective view of the awning bracket according to the invention.
Figure 2:
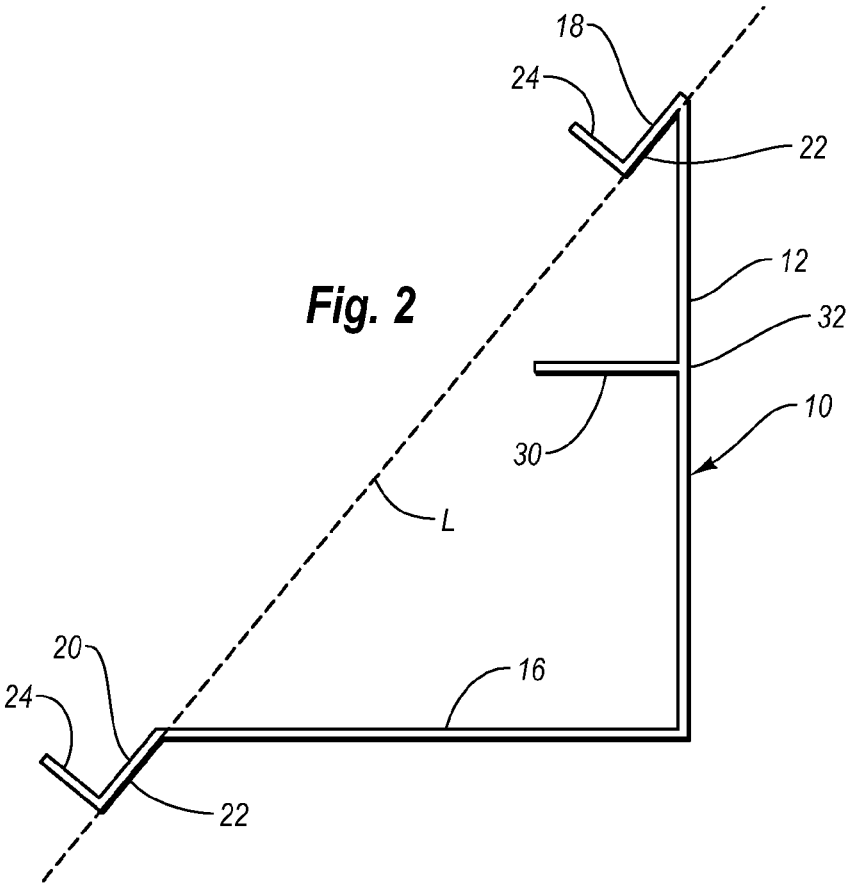
FIG. 2 is a side view of the awning bracket hereof.
Figure 3:
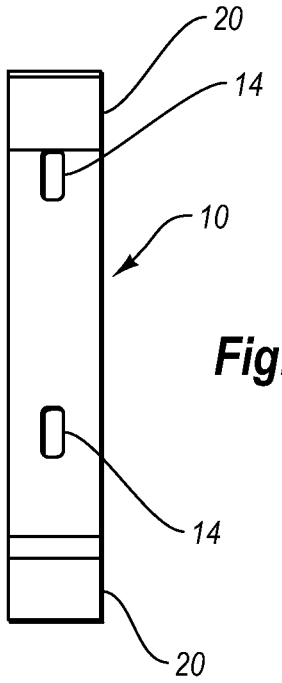
FIG. 3 is a rear view of the awning bracket hereof.

This invention is directed to an awning and light support system, and kit of components, of the type to provide sun and rain protection to a window or door of a structure. More particularly the invention relates to an easily installed system that includes a pair of uniquely constructed L-shaped bracket members for mounting to the respective sides of the window or door. The details of the system will become clearer in the following description and accompanying drawings, where like reference numerals represent like components or features throughout the several views.

Turning now to FIGS. 1-4, illustrating different views of a uniquely constructed bracket member of this invention, FIG. 1 shows an L-shaped bracket member 10. The bracket member 10, one of a pair of brackets that may be removably secured at the respective sides of a window or door, comprises a vertically oriented leg 12, containing plural fastener receiving apertures 14 for mounting such leg proximate to a structure by lag bolts as known in the art. Joined to and perpendicular thereto is a horizontally oriented leg 16.

Figure 4:
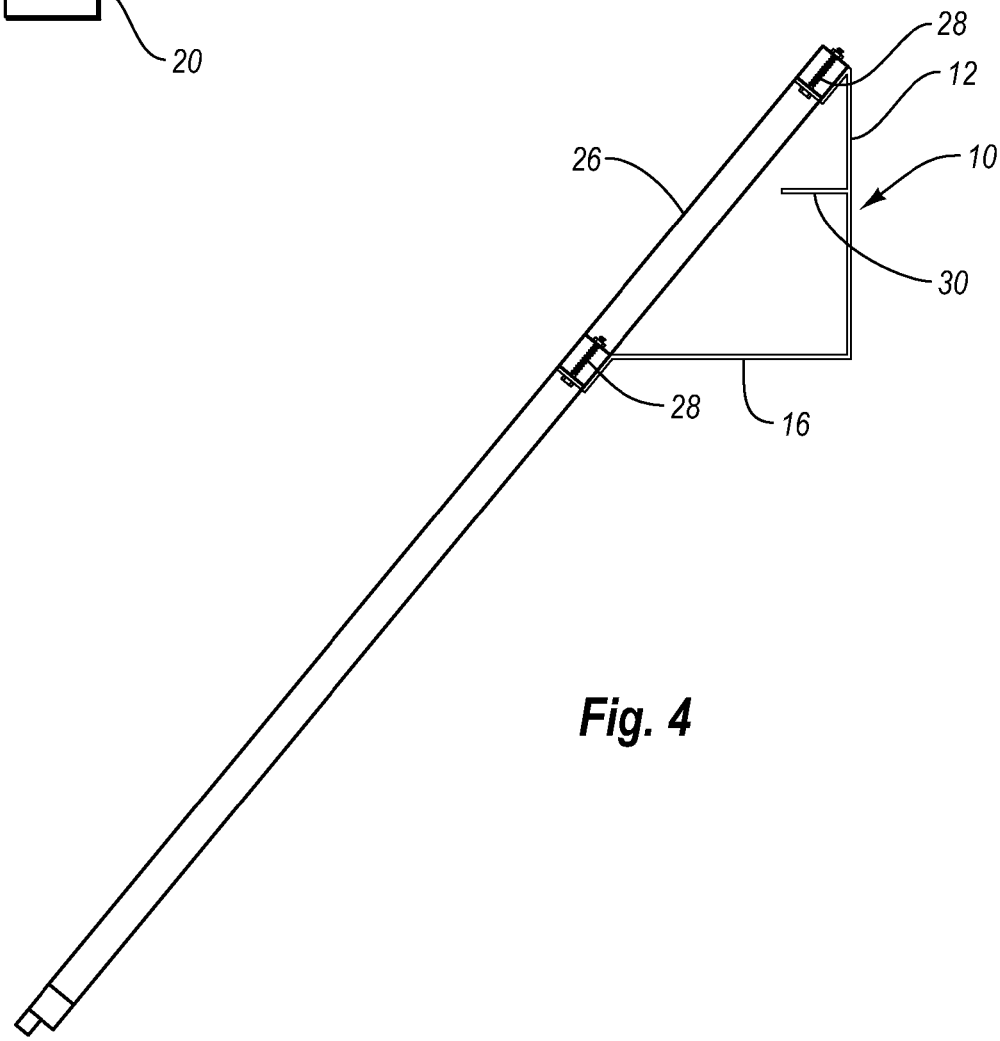
FIG. 4 is a further side view of the awing bracket of this invention, showing the bracket in a supporting relationship to an angled awning.

The respective free ends 18, 20, of the bracket member legs 12, 16, may be L-shaped configurations having first downwardly angled arms 22, in a common alignment illustrated by the theoretical line L, terminating in perpendicular arms 24. As best seen in FIG. 4 said free ends 18, 20 are used to secure support members 40 and an awning spar support 26 through fastener members 28. By the use of a pair of such bracket members 10, a single person can easily install the awning over a selected window or door. Further, to provide lighting to the underside of the awning, the vertically oriented leg 12 is provided with an inwardly directed leg 30, essentially parallel to said horizontally oriented leg 16, from a midpoint 32 of the leg 12, where the inwardly directed leg 30 does not extend to the theoretical line L illustrating the alignment of downwardly angled arms 22. Inwardly directed legs 30 provide a means of mounting a light fixture, as known in the art.

It is recognized that changes, variations and modifications may be made to the system and bracket members of this invention, particularly by those skilled in the art, without departing from the spirit and scope thereof. Accordingly, no limitation is intended to be imposed thereon except as set forth in the accompanying claims.

I claim:

1. A mounting bracket comprising:

a first leg, comprising a first end and a second end;

a second leg, comprising a first end and a second end, wherein the first end of the second leg is perpendicularly coupled to the first end of the first leg;

a first L-shaped support member, comprising a first arm perpendicularly coupled to a second arm, wherein the first arm of the first L-shaped support member is coupled to the second end of the first leg; and a second L-shaped support member, comprising a first arm perpendicularly coupled to a second arm, wherein the first arm of the second L-shaped support member is coupled to the second end of the second leg, and wherein the first arm of the first L-shaped support member and the first arm of the second L-shaped support member are substantially aligned and define a common line.

2. The mounting bracket as in claim 1, further comprising an inwardly directed leg, comprising a first end and a second end, wherein the first end of the inwardly directed leg is coupled to the first leg, and wherein the inwardly directed leg and the second leg extend in substantially the same direction from the first leg.

3. The mounting bracket as in claim 2, wherein the inwardly directed leg is coupled to the first leg at a midpoint of the first leg.

4. The mounting bracket as in claim 2, wherein the inwardly directed leg is parallel to the second leg.

5. The mounting bracket as in claim 2, wherein the inwardly directed leg has a length shorter than the distance between the first leg, at the point where the inwardly directed leg is attached to the first leg, and the common line defined by the first arms of the first and second L-shaped support members, as measured on a line parallel to the inwardly directed leg.

6. The mounting bracket as in claim 1, wherein the first leg further comprises at least one aperture configured to receive fasteners for mounting the mounting bracket.

7. A mounting bracket system comprising:

a first mounting bracket comprising:

a first leg, comprising a first end and a second end;

a second leg, comprising a first end and a second end, wherein the first end of the second leg is perpendicularly coupled to the first end of the first leg;

a first L-shaped support member, comprising a first arm perpendicularly coupled to a second arm, wherein the first arm of the first L-shaped support member is coupled to the second end of the first leg; and a second L-shaped support member, comprising a first arm perpendicularly coupled to a second arm, wherein the first arm of the second L-shaped support member is coupled to the second end of the second leg, and wherein the first arm of the first L-shaped support member and the first arm of the second L-shaped support member are substantially aligned and define a common line; and a second mounting bracket configured substantially the same as the first mounting bracket.

8. The mounting bracket system of claim 7, wherein the support members of the mounting brackets are configured to support an awning.

9. The mounting bracket system of claim 7, wherein the first and second mounting brackets further comprise an inwardly directed leg, comprising a first end and a second end, wherein the first end of the inwardly directed leg is coupled to the first leg at a midpoint between the first end and the second end of the first leg, and wherein the inwardly directed leg and the second leg are parallel and extend in the same direction from the first leg.

10. The mounting bracket system of claim 9, wherein the inwardly directed legs are configured to support a lighting structure.

11. A mounting bracket comprising:

a first leg, comprising a first end and a second end;

a second leg, comprising a first end and a second end, wherein the first end of the second leg is perpendicularly coupled to the first end of the first leg;

a first support member, comprising a first arm, wherein the first arm of the first support member is coupled to the second end of the first leg and is not perpendicular to or inline with the first leg;

a second support member, comprising a first arm, wherein the first arm of the second support member is coupled to the second end of the second leg and is not perpendicular to or inline with the first leg, and wherein the first arm of the first support member and the first arm of the second support member are substantially parallel; and an inwardly directed leg, comprising a first end and a second end, wherein the first end of the inwardly directed leg is coupled to the first leg at a midpoint of the first leg, and wherein the inwardly directed leg and second leg are parallel and extend in the same direction from the first leg.

12. The mounting bracket as in claim 11, wherein the first leg further comprises:

at least one aperture configured to receive fasteners for mounting the mounting bracket.

13. A mounting bracket comprising:

a first leg, comprising a first end and a second end;

a second leg, comprising a first end and a second end, wherein the first end of the second leg is perpendicularly coupled to the first end of the first leg a first support member, comprising:

a first arm, wherein the first arm of the first support member is coupled to the second end of the first leg and is not perpendicular to or inline with the first leg; and a second arm perpendicularly coupled to the first arm of the first support member; and a second support member, comprising a first arm, wherein the first arm of the second support member is coupled to the second end of the second leg and is not perpendicular to or inline with the first leg, and wherein the first arm of the first support member and the first arm of the second support member are substantially parallel.

14. A mounting bracket comprising:

a first leg, comprising a first end and a second end;

a second leg, comprising a first end and a second end, wherein the first end of the second leg is perpendicularly coupled to the first end of the first leg;

a first support member, comprising a first arm, wherein the first arm of the first support member is coupled to the second end of the first leg and is not perpendicular to or inline with the first leg; and a second support member, comprising:

a first arm, wherein the first arm of the second support member is coupled to the second end of the second leg and is not perpendicular to or inline with the first leg, and wherein the first arm of the first support member and the first arm of the second support member are substantially parallel; and a second arm perpendicularly coupled to the first arm of the second support member.

* * * * *